US005362332A

United States Patent [19]

Shimizu et al.

[11] Patent Number: 5,362,332

[45] Date of Patent: Nov. 8, 1994

[54] PROCESS FOR PRODUCING A MAGNET BASE FOR PRINTING HEAD OF A WIRE DOT PRINTER

[75] Inventors: Yutaka Shimizu; Yoshihiko Seyama, both of Kawasaki, Japan

[73] Assignee: Fujitsu Limited, Kawasaki, Japan

[21] Appl. No.: 132,838

[22] Filed: Oct. 7, 1993

[30] Foreign Application Priority Data

Mar. 17, 1993 [JP] Japan ..... 5-057221

[51] Int. Cl.[5] ..... H01F 1/22

[52] U.S. Cl. ..... 148/105; 419/36; 419/37; 427/132

[58] Field of Search ..... 419/36, 37, 38; 427/128, 132; 148/104, 105

[56] References Cited

U.S. PATENT DOCUMENTS 4,867,943 9/1989 Kiyota ..... 419/36
5,256,326 10/1993 Kawato et al. ..... 148/105

FOREIGN PATENT DOCUMENTS 60-254603 12/1985 Japan .
2-138443 5/1990 Japan .

*Primary Examiner*—George Wyszomierski
*Attorney, Agent, or Firm*—Staas & Halsey

[57] ABSTRACT

A magnet base, having a flux density equal to that of an Fe-50%Co alloy and an input current response equal to that of an Fe—Si alloy, is used as a component of the magnetic circuit employed for a printing head of a wire dot printer, the magnetic circuit further having by-pass and armature components. The material of the magnetic base is an Fe-50% Co alloy and the base has an end face which is perpendicular to the magnetic circuit of the printing head. A layer, of a material selected from the class consisting of metals and metal alloys which function to increase the specific resistance of a magnet bases of an Fe-50% Co alloy, is formed on the end face of the magnet base and reduces eddy current loss therein, particularly at high frequency energization of the magnetic circuit, further serving to increase the input current response. The magnet base is formed by kneading soft magnetic powder, comprising the Fe-50% Co alloy, and a binder to form a kneaded mixture which is injection molded into the desired shape of the magnet base, heated for removing the binder and producing a degreased structure, and which then is sintered. The sintered base then is annealed and the layer formed on the end surface by vacuum deposition; alternatively, the layer may be vacuum deposited on the end surface of the sintered magnetic base and the composite structure then annealed.

15 Claims, 4 Drawing Sheets

PROCESS FOR PRODUCING A MAGNET BASE FOR PRINTING HEAD OF A WIRE DOT PRINTER

BACKGROUND OF THE INVENTION

1. Field of the Invention

This invention relates to a magnet base useful for a printing head and capable of improving the printing speed of a wire dot printer and a process for producing the magnet base.

2. Description of the Related Art

To improve a printing speed of a wire dot printer, it is very important to improve the magnetic flux density and response of a magnet base used for the printing head. An Fe-Si alloy having a high magnetic flux density and small coercive force has been used as a material of the magnet base. However, as a higher printing speed has become necessary, the use of an Fe-50%Co alloy having a higher magnetic flux density has been attempted. This Fe-50%Co alloy has the highest magnetic flux density among metal materials known to this date. However, since its specific resistance is low, the eddy current loss is great at high frequency, the input current response is low, and the application of this material to the magnet base for high-speed printing is difficult.

SUMMARY OF THE INVENTION

Accordingly, a magnet base having a magnetic flux density similar to that of the Fe-50%Co alloy and input current response characteristics similar to those of the Fe-Si alloy has been required. The present invention aims at providing a magnet base satisfying such requirements and a process for producing the same.

To accomplish the object described above, the present invention provides a magnet base for use in a printing head of a wire dot printer comprising a magnet base, a by-pass and an amature, wherein a magnet base material comprises an Fe-50%Co alloy, and a layer of a metal or alloy for increasing the specific electrical resistance of the magnet base material is formed on the end face of a portion which becomes perpendicular to a magnetic circuit when the magnet base is assembled into the printing head of the wire dot printer.

The present invention also provides a process for producing a magnet base for use in a printing head of a wire dot printer comprising a magnet base, a by-pass and an armature, which comprises the steps of kneading soft magnetic powder comprising an Fe-50%Co alloy and a binder, injection molding the kneaded mixture, heating the resulting mold in a degreasing furnace to remove the binder and to obtain a degreased molded article, sintering the degreased body to produce a magnet base, and forming a layer of a metal or alloy, for increasing the specific resistance of the magnet base material comprising the Fe-50%Co alloy, on an end face of a portion thereof which is disposed in perpendicular relationship to a magnetic circuit when the magnet base is assembled with the printing head.

DESCRIPTION OF THE PREFERRED EMBODIMENTS

According to the present invention, a layer of a metal or alloy, employed for increasing the specific resistance of the magnet base material, is formed on the end face of the portion of the magnet base which is disposed in perpendicular relationship to the magnetic circuit of the printing head, by vacuum deposition or plating. In the production of such a magnet base, a magnet base sintered body, obtained by sintering a degreased body, is generally annealed magnetically. This annealing is carried out in order to eliminate magnetic strain of the crystal and to improve magnetic characteristics by keeping the magnet base sintered body at a temperature higher than a magnetic transformation point and then slowly cooling it. Accordingly, when magnetic annealing is carried out after the formation of the metal or alloy layer in the present invention, the metal or alloy is diffused into the magnet base material from the end face during the magnetic annealing process, and a gradient composition region of the magnet base material and the metal or alloy is formed in the proximity of this end face.

Because the layer of the metal or alloy for increasing the specific resistance of the magnet base material is formed on the end face of the magnet base portion which is disposed in perpendicular relationship to the magnetic circuit of the printing head, the resistance of the magnetic circuit becomes greater as a whole. Therefore, even when a high frequency electric field is applied, the eddy current loss is reduced and the maximum induction current is increased. Accordingly, a magnet base having excellent input current response can be obtained. When the gradient composition layer of the magnetic base material and the metal or alloy layer for increasing the specific resistance of the magnet base material is formed by magnetic annealing, the resistance of the magnetic circuit can be further increased as a whole, the eddy current loss can be further decreased when a high frequency electric field is applied, and a magnet base having an excellent input current response can be obtained.

Hereinafter, preferred embodiments of the present invention will be explained with reference to the accompanying drawings.

Figure 1:
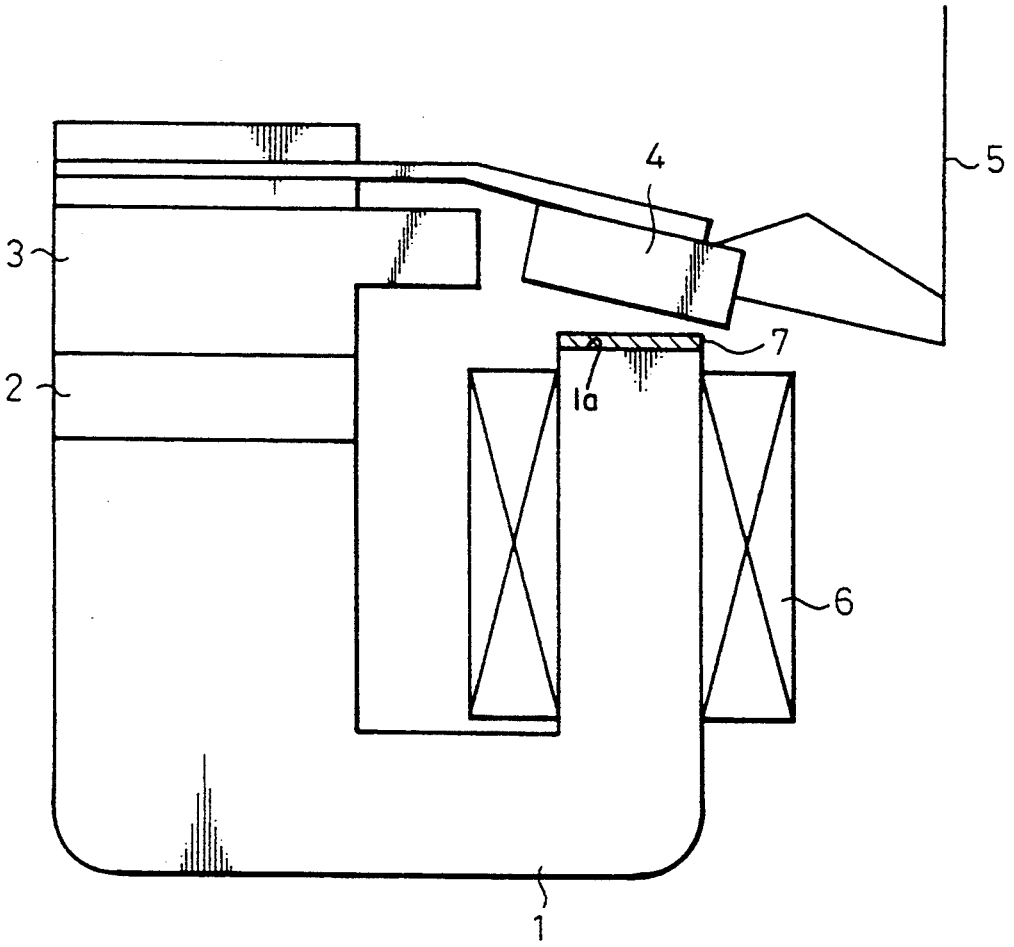
FIG. 1 is a conceptual view showing a printing head for a wire dot printer which includes a magnet base according to the present invention.

FIG. 1 is a perspective view of a printing head for a wire dot printer equipped with a magnet base according to the present invention. This printing head includes a magnet base 1 made of an Fe-50%Co alloy, a permanent magnet 2, a by-pass 3, an armature 4, a wire 5 and an excitation coil 6. A metal or alloy layer 7 for increasing the specific resistance of the magnet base material is formed on an end face 1*a* of the magnet base 1 perpendicular to a magnetic circuit.

Figure 2:
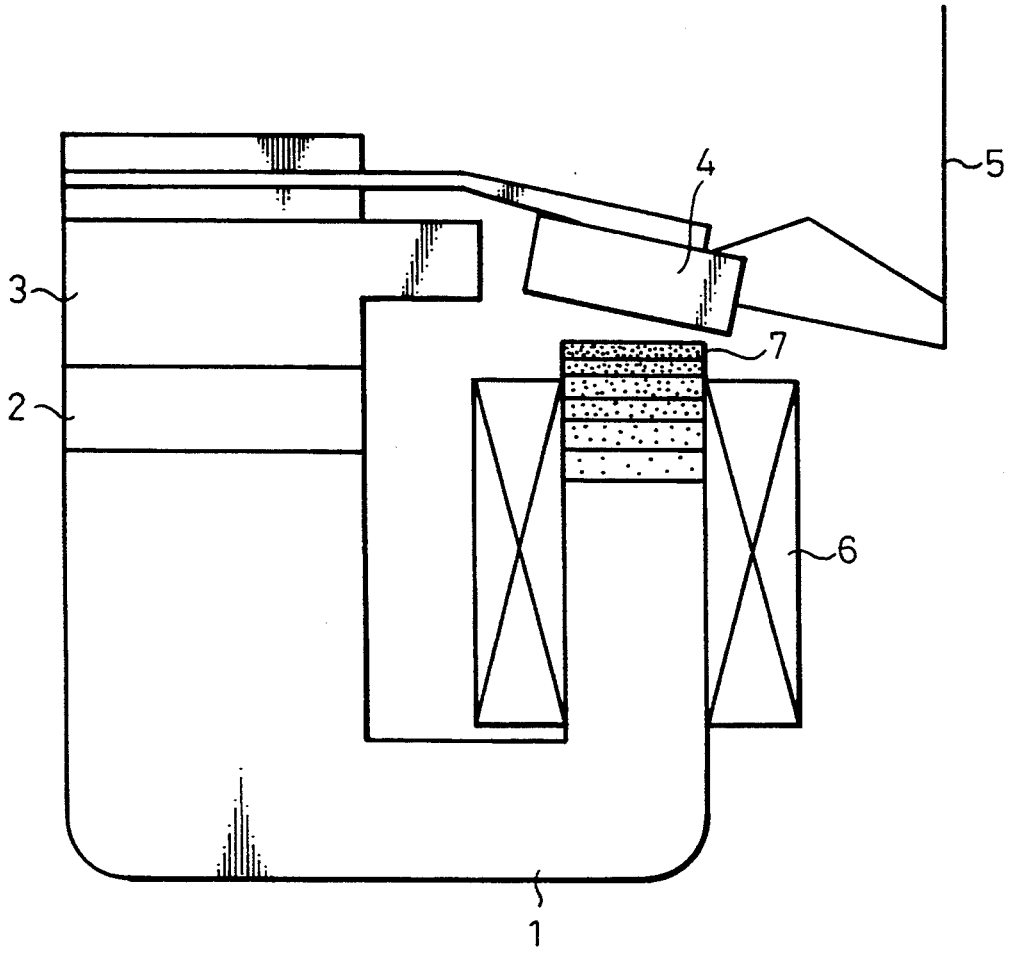
FIG. 2 is a conceptual view showing a printing head for a wire dot printer including a preferred magnet base according to the present invention.

FIG. 2 is a perspective view showing a printing head for a wire dot printer equipped with a preferred magnet base according to the present invention. In the same way as the printing head shown in FIG. 1, this printing head includes a magnet base 1 made of an Fe-50%Co alloy, a permanent magnet 2, a by-pass 3, an armature 4, a wire 5 and an excitation coil 6. However, a metal or alloy layer 7 for increasing the specific resistance of the magnet base material, which is formed on the end face of the magnet base 1 perpendicular to the magnetic circuit, is constituted as a layer for gradually changing the composition between the metal or alloy layer, which is employed for increasing the specific resistance of the magnet base, and the magnet base material.

Figure 3:
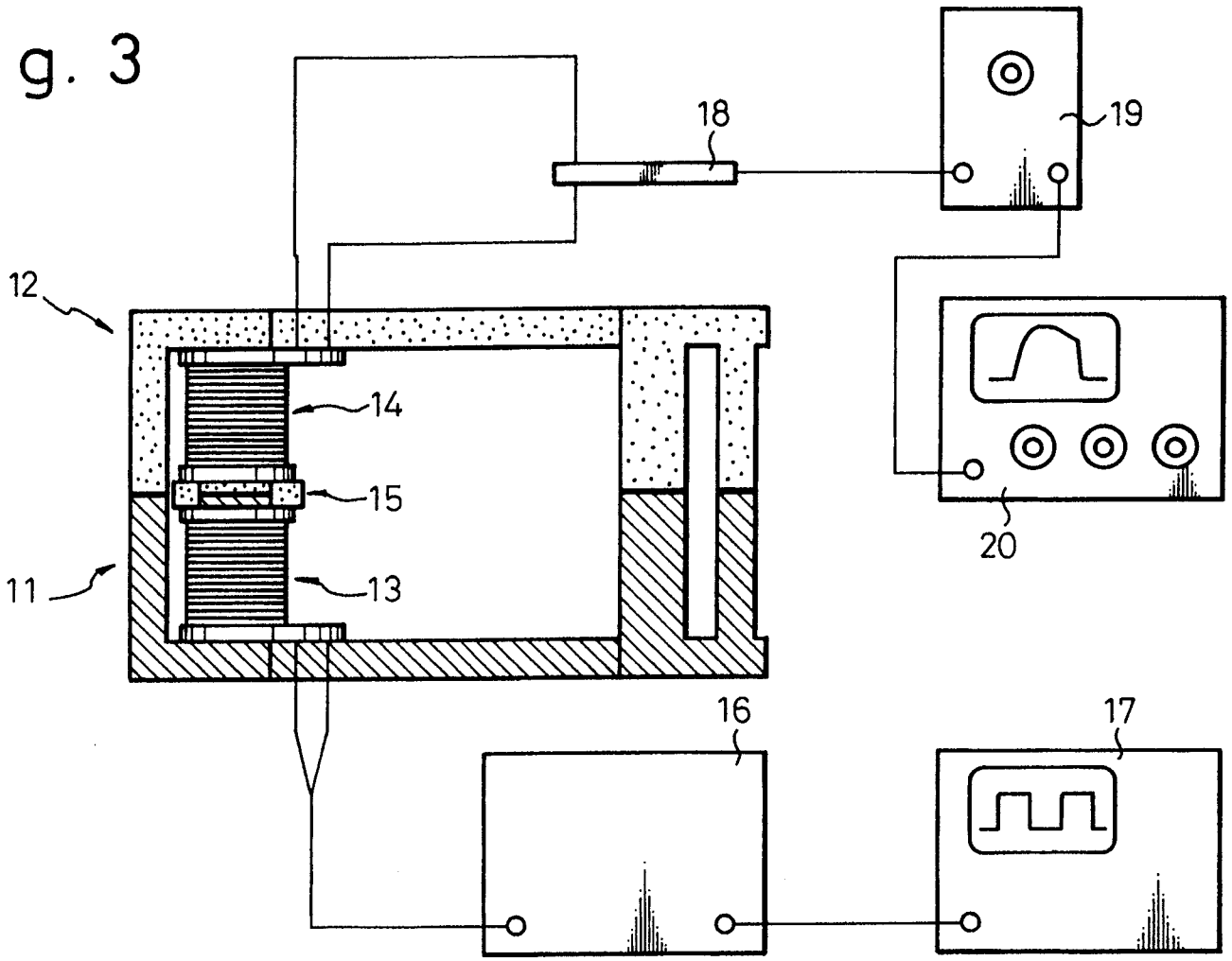
FIG. 3 is a conceptual view showing an apparatus used for measuring an induction current waveform of a magnet base produced in accordance with an embodiment of the present invention.

FIG. 3 is a block diagram showing an apparatus used for measuring an induction current waveform of the magnet base of the present invention. Reference numeral 11 denotes a magnet base to be measured, 12 is a magnet base for detection which is made of an Fe-30%Co alloy, 13 is an impression coil, 14 is a detection coil, 15 is a spacer made of a silicone rubber, 16 is a high speed power amplifier, 17 is a a function generator, 18 is a current probe, 19 is an amplifier, and 20 is an oscilloscope.

EXAMPLE 1

Figure 4:
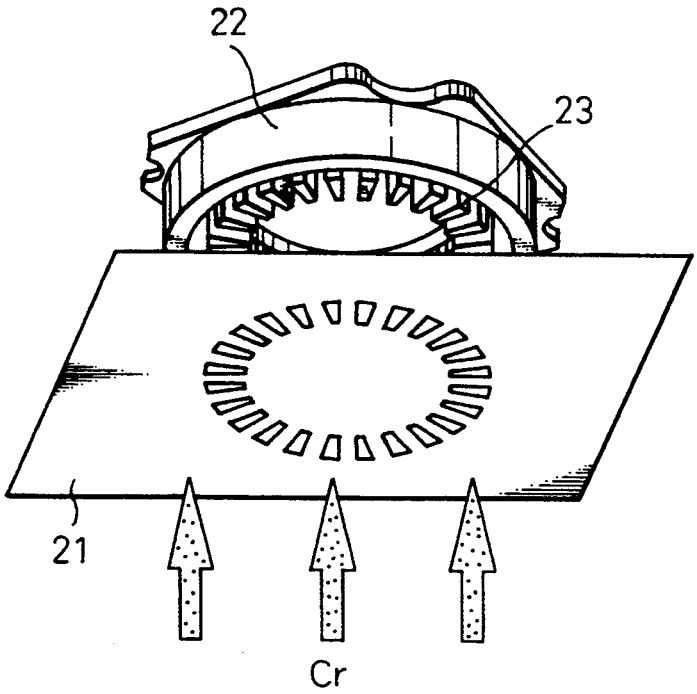
FIG. 4 is an explanatory view useful for explaining a vacuum deposition method for a metal, as employed in accordance with an embodiment of the present invention.

65 vol % of Fe-50%Co alloy powder, having a mean particle size of 20 μm, and 35 vol % of a binder, consisting of polyethylene and polymethyl methacrylate as the principal components, were kneaded, and a magnet base was injection molded, degreased and sintered. After the magnet base was annealed at a maximum temperature of 1,150° C. in a hydrogen atmosphere, Cr was vacuum deposited on the end faces of the pin portions 23 of the magnet base 22 to a thickness of 0.5 to 10 μm using a metal mask 21 as shown in FIG. 4. The specific resistance of the resulting magnet base was measured, and the maximum induction current value and rise time were also measured base on an induction current waveform obtained by the use of the apparatus shown in FIG. 3. The results of the measurement are tabulated in Table 1.

TABLE 1

| | metal layer material | | |
|---|---|---|---|
| | | Cr | |
| annealing | nil | nil | made |
| specific resistance (μΩ cm) | 6.4 | 9.8 | 12.9 |
| maximum induction current (mA) | 63.6 | 66.0 | 72.4 |
| maximum induction current arrival time (Asec) | 120 | 122 | 124 |
| current increase ratio (mA/μsec) | 0.53 | 0.54 | 0.58 |

EXAMPLE 2

A magnet base was produced in exactly the same way as in Example 1 and various performances were measured. In this Example, however, vacuum deposition of Cr was conducted after the production of the sintered body, and thereafter annealing was effected. The results are likewise tabulated in Table 1.

EXAMPLE 3

Figure 5:
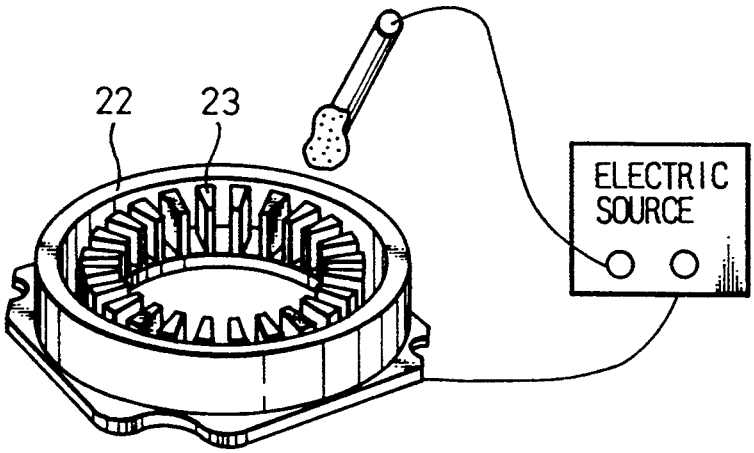
FIG. 5 is an explanatory view useful for explaining a brush plating method of a metal or an alloy, as employed in accordance with an embodiment of the present invention.

65 vol % of Fe-50%Co alloy powder, having a mean particle size of 20 μm, and 35 vol % of a binder, consisting of polyethylene and polymethyl methacrylate as the principal components were kneaded, and a magnet base was injection molded, degreased and sintered. Next, after the magnet base was annealed at a maximum temperature of 1150° C. in a hydrogen atmosphere, each of a Cr metal film and of Ni—Cr, Ni—W or Ni-Co alloy films was vacuum deposited on the end faces of pin portions 23 of the magnet base 22, using a brush plating method as shown in FIG. 5, to a film thickness of 0.5 to 10 μm. The specific resistance of the resulting magnet base was measured, and a maximum induction current value and a rise time were also measured, based on an induction current waveform obtained by the apparatus shown in FIG. 3. The results are tabulated in Table 2.

EXAMPLE 4

A magnet base was produced in exactly the same way as in Example 3, and various performance was measured. However, each of the metal film and of the alloy films was formed after the production of the sintered body and thereafter annealing was conducted in this Example. The results are tabulated in Table 2.

TABLE 2

| | metal layer material | | | | | | | | |
|---|---|---|---|---|---|---|---|---|---|
| | nil | Cr | | Ni—Cr | | Ni—W | | Ni—Co | |
| annealing | — | nil | made | nil | made | nil | made | nil | made |
| specific resistance (μΩ cm) | 6.4 | 10.1 | 14.5 | 10.1 | 16.1 | 9.9 | 15.0 | 9.2 | 14.2 |
| maximum induction current (mA) | 63.6 | 66.0 | 76.0 | 66.4 | 80.0 | 65.6 | 76.4 | 63.6 | 73.6 |
| maximum induction current arrival time mA/usec | 120 | 124 | 124 | 122 | 136 | 122 | 124 | 120 | 124 |
| current increase ratio (μsec) | 0.53 | 0.53 | 0.61 | 0.54 | 0.59 | 0.54 | 0.62 | 0.53 | 0.59 |

According to the present invention, a printing head having excellent response can be obtained even when an Fe-50%Co alloy is used as a material of a magnet base for a printing head of a wire dot printer.

We claim:

1. A process for producing a magnet base for use in a magnetic circuit of a printing head of a wire dot printer, the magnetic circuit comprising the magnet base, a by-pass and an armature, which process comprises the steps of:

kneading soft magnetic powder comprising an Fe-50%Co alloy and a binder, thereby forming a kneaded mixture;

injection molding the kneaded mixture thereby forming a molded article;

heating the molded article in a degreasing furnace to remove said binder, thereby producing a degreased article;

sintering said degreased article, thereby providing a sintered article annealing the sintered article, thereby to producing the magnet base, the magnet base having a portion aligned with and defining the magnetic flux path of the magnetic circuit and an end face perpendicular to the magnetic flux path; and at a time prior to or subsequently to the annealing step, forming a layer of a material, selected from the group consisting of metals and alloys which increase a specific electrical resistance of a magnetic base material comprising the Fe-50%Co alloy, on the end face of said magnet base which is perpendicular to the magnetic circuit.

2. A process according to claim 1, wherein the layer of the selected material is formed on the end face of the portion of said magnetic base by vacuum deposition or by plating.

3. A process according to claim 1, wherein said material is selected from the group consisting of Cr metal, of a Ni—Cr alloy, a Ni—W alloy, and a Ni—Co alloy.

4. A process according to claim 1, wherein the sintered article is annealed magnetically.

5. A process according to claim 4, wherein the magnetic annealing is carried out after the formation of the layer of the selected material.

6. A process for producing a magnet base used as a component of a magnetic circuit of a printing head of a wire dot printer, the magnetic circuit comprising the magnet base, a by-pass and an armature, the process comprising the steps of:

kneading soft magnetic powder comprising an Fe-50% Co alloy and a binder, thereby forming a kneaded mixture;

injection molding the kneaded mixture thereby forming a molded article in accordance with a desired configuration of the magnet base;

heating the molded article in a degreasing furnace to remove the binder and thereby producing a degreased, molded article;

sintering the degreased, molded article, thereby producing a sintered article;

annealing the sintered article, thereby producing the magnet base, the magnet base having a portion aligned with and defining the magnetic flux path of the magnetic circuit and an end face perpendicular to the magnetic flux path; and prior to or subsequently to the annealing step, forming a layer of a material, selected from the group consisting of metals and metal alloys which increase the specific electrical resistance of the magnet base, on an end face of the magnet base which is perpendicular to the magnetic circuit.

7. A process according to claim 6, wherein the layer of the selected material is formed on the end face of the portion of said magnetic base by vacuum deposition or by plating.

8. A process according to claim 6, wherein, said material is selected from the group consisting of Cr metal, a Ni—Cr alloy, a Ni—W alloy, and a Ni—Co alloy.

9. A process according to claim 6, wherein the sintered article is annealed magnetically.

10. A process according to claim 9, wherein the magnetic annealing is carried out after he formation of the layer of the selected material.

11. A process for producing a magnet base component of a magnetic circuit, the process comprising the steps of:

kneading soft magnetic powder comprising an Fe-50% Co alloy and a binder thereby forming a kneaded mixture;

injection molding the kneaded mixture thereby forming a molded article in accordance with a desired configuration of the magnet base;

heating the molded article in a degreasing furnace to remove the binder thereby producing a degreased, molded article;

sintering the degreased, molded article thereby producing a sintered article;

annealing the sintered article, thereby producing the magnet base, the magnet base having a portion aligned with and defining the magnetic flux path of the magnetic circuit and an end face perpendicular to the magnetic flux path; and prior to or subsequently to the annealing step, forming a layer of a material, selected from the group consisting of metals and metal alloys which increase the specific electrical resistance of the magnet base, on an end face of the magnet base which is perpendicular to the magnetic circuit.

12. A process according to claim 11, wherein the layer of the selected material is formed on the end face of the portion of said magnetic base by vacuum deposition or by plating.

13. A process according to claim 11, wherein said material is selected from the group consisting of Cr metal, a Ni—Cr alloy, a Ni—W alloy, and a Ni—Co alloy.

14. A process according to claim 11, wherein the sintered article is annealed magnetically.

15. A process according to claim 14, wherein the magnetic annealing is carried out after the formation of the layer of the selected material.

* * * * *

UNITED STATES PATENT AND TRADEMARK OFFICE

CERTIFICATE OF CORRECTION

PATENT NO. : 5,362,332

DATED : November 8, 1994

INVENTOR(S) : Yutaka SHIMIZU et al.

It is certified that error appears in the above-indentified patent and that said Letters Patent is hereby corrected as shown below:

Col. 1, line 39, change "amature" to --armature--.

Col. 3, line 39, change "base" to --based--.

Col. 4, Table 1, change "arrival time (Asec)" to --arrival time (μsec)--;
Table 2, change "mA/usec" to --mA/μsec--.

Col. 5, line 42, change "binder and" to --binder,--.

Signed and Sealed this

Tenth Day of January, 1995

*Attest:*

*Attesting Officer*

BRUCE LEHMAN

*Commissioner of Patents and Trademarks*